US008961226B2

(12) United States Patent
Shinkawa et al.

(10) Patent No.: US 8,961,226 B2
(45) Date of Patent: Feb. 24, 2015

(54) CONNECTOR

(75) Inventors: Daisuke Shinkawa, Makinohara (JP); Tomihiko Nagayoshi, Kikugawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/814,601

(22) PCT Filed: Jul. 29, 2011

(86) PCT No.: PCT/JP2011/067506

§ 371 (c)(1),
(2), (4) Date: Feb. 6, 2013

(87) PCT Pub. No.: WO2012/029483

PCT Pub. Date: Mar. 8, 2012

(65) Prior Publication Data

US 2013/0130562 A1 May 23, 2013

(30) Foreign Application Priority Data

Aug. 30, 2010 (JP) ..... 2010-192424

(51) Int. Cl.
*H01R 13/40* (2006.01)
*H01R 13/432* (2006.01)
*H01R 13/422* (2006.01)

(52) U.S. Cl.
CPC ..... *H01R 13/432* (2013.01); *H01R 13/4223* (2013.01)
USPC ..... 439/595

(58) Field of Classification Search
USPC ..... 439/595, 744, 871
See application file for complete search history.

(56) References Cited

U.S. PATENT DOCUMENTS

| | | | | |
|---|---|---|---|---|
| 5,115,281 | A | 5/1992 | Ohtsuka et al. | |
| 5,516,311 | A * | 5/1996 | Maejima | 439/877 |
| 5,645,453 | A * | 7/1997 | Yamaguchi | 439/595 |
| 5,697,813 | A * | 12/1997 | Ikeda | 439/595 |
| 5,716,235 | A | 2/1998 | Endo et al. | |
| 8,083,543 | B2 * | 12/2011 | Omori et al. | 439/511 |
| 2006/0141862 | A1 | 6/2006 | Machida et al. | |

(Continued)

FOREIGN PATENT DOCUMENTS

| | | | |
|---|---|---|---|
| CN | 1685573 | A | 10/2005 |
| JP | 63-29864 | U | 2/1988 |

(Continued)

OTHER PUBLICATIONS

International Search Report dated Oct. 25, 2011 issued in International Application No. PCT/JP2011/067506 (PCT/ISA/210).

(Continued)

*Primary Examiner* — Phuong Dinh
(74) *Attorney, Agent, or Firm* — Sughrue Mion, PLLC

(57) ABSTRACT

A connector 11 including a flexible engagement piece 25 which has a base end supported like a cantilever in a terminal accommodation chamber 17 for accommodating a terminal fitting and is thus deformable elastically, and has a free end 27 with which the terminal fitting to be inserted into the terminal accommodation chamber 17 is engaged, wherein the flexible engagement piece 25 having a beak 31 formed on the free end 27 to be engaged with the terminal fitting takes a shape of an inclined surface 29 having a height of a top portion 41 increased gradually from the free end 27 toward the base end in such a manner that a maximum shear area is obtained by a shear force of the terminal fitting.

2 Claims, 4 Drawing Sheets

(56) References Cited

U.S. PATENT DOCUMENTS

| | | | | |
|---|---|---|---|---|
| 2006/0141863 | A1* | 6/2006 | Sakamoto | 439/595 |
| 2010/0203756 | A1* | 8/2010 | Omori et al. | 439/507 |

FOREIGN PATENT DOCUMENTS

| | | | |
|---|---|---|---|
| JP | 1107883 | U | 7/1989 |
| JP | 392367 | U | 9/1991 |
| JP | 8-185919 | A | 7/1996 |
| JP | 9-035799 | A | 2/1997 |
| JP | 2003-115336 | A | 4/2003 |
| JP | 2004362831 | A | 12/2004 |
| JP | 2007220354 | A | 8/2007 |
| WO | 2009/078374 | A1 | 6/2009 |

OTHER PUBLICATIONS

Written Opinion dated Oct. 25, 2011 issued in International Application No. PCT/JP2011/067506 (PCT/ISA/237).

Japanese Office Action dated Jul. 10, 2014 issued by Japanese Patent Office in counterpart Japanese application No. 2010-192424.

Office Action dated Sep. 19, 2014 issued by the State Intellectual Property Office of P.R. China in counterpart Chinese Application No. 201180040796.8.

* cited by examiner

CONNECTOR

TECHNICAL FIELD

The present invention relates to a connector in which a cantilever-shaped flexible engagement piece is provided in a terminal accommodation chamber and a terminal fitting to be inserted into the terminal accommodation chamber is engaged with a free end thereof.

BACKGROUND ART

Referring to a connector which engages a flexible engagement piece with a terminal fitting and causes a terminal accommodation chamber to hold the same therein, a rigidity of the flexible engagement piece is lowered due to a reduction in a size. For this reason, there is a fear that a reliability of a function for preventing a slip-off of the terminal fitting might be deteriorated. For example, Patent Document 1 discloses a connector which tries to solve the problem. In a connector shown in FIGS. 7(*a*) and 7(*b*), a front end side of a flexible engagement piece (which will also be referred to as a "lance") 501 is set to be an equal width portion 503 having a small width and a residual portion is set to be a taper portion 505 having a width increased gradually toward a base end. A reinforcing bead 507 is formed on a central part in a transverse direction over a lower surface of the lance 501, that is, an opposed surface to a flexure space.

The reinforcing bead 507 has an almost equal width to that of the equal width portion 503 of the lance 501 and has a starting end set to be a position recessed slightly backward from a starting end position of the taper portion 505 of the lance 501, and is formed with a backward extension over an external surface of a lower surface wall 511 of a cavity 509 forming a terminal accommodation chamber from the lance 501. A base end side to be a flexure supporting point of the lance 501 is set to be wide, and furthermore, the reinforcing bead 507 can also be set to be wide. Consequently, it is possible to obtain a high rigidity. Thus, it is possible to obtain a great elastic force, thereby enhancing the reliability of the function for preventing the slip-off of the terminal. Moreover, the width of the reinforcing bead 507 can be varied within a wide range so that the rigidity of the lance 501 can be regulated within a wide range.

PRIOR ART DOCUMENT

Patent Document

Patent Document 1: JP-A-2007-220354 Publication

SUMMARY OF THE INVENTION

Problems that the Invention is to Solve

In recent years, a connector has a problem in that a terminal holding force of a flexible engagement piece is reduced during the advance of a decrease in a size of the connector. A reduction in a size of a lance exactly implies the reduction in the holding force. For this reason, it is an object to cause both the reduction in the size and the maintenance of the holding force to be compatible with each other. Referring to the conventional connector, the reinforcing bead 507 is provided to enhance the holding force against the reduction in the lance holding force which is caused by the decrease in the size. However, it is impossible to suppress a shear fracture of the terminal engagement portion (a beak) of the lance which is caused by the reduction in the size. It is known that the shear fracture in this case is propagated obliquely toward an upper surface of the beak at a predetermined angle from a contact point of a terminal contact tip surface. On the other hand, when a height of the terminal contact tip surface is simply increased to substantially increase a shear fracture length in order to enhance a shear fracture strength, a partner side male terminal tab and an upper surface of the lance beak are apt to interfere with each other so that it is impossible to bring an excellent terminal engagement situation. Also in a terminal release, moreover, a hanging margin of the beak with respect to a terminal engagement hole is made excessive when the height of the terminal contact tip surface is increased. Consequently, there is caused a problem in that a releasing performance is deteriorated. If the height of the whole lance beak is increased to enhance the shear fracture strength, thus, a disadvantage is caused in an engagement state or a disengagement. In addition, an unnecessary increase in a material is caused so that an influence on an environment is also increased, resulting in an inefficient improvement.

The invention has been made in consideration of the situation and has an object to provide a connector capable of efficiently enhancing a shear strength to increase a holding force against a reduction in a lance holding force which is caused by a decrease in a size.

Means for Solving the Problem

The object according to the invention can be achieved by the following structure.

(1) A connector including a flexible engagement piece which has a base end supported like a cantilever in a terminal accommodation chamber for accommodating a terminal fitting and is thus deformable elastically, and has a free end with which the terminal fitting to be inserted into the terminal accommodation chamber is engaged, wherein the flexible engagement piece having a beak formed on the free end to engage the terminal fitting therewith takes a shape of an inclined surface having a height of a top portion increased gradually from the free end toward the base end in such a manner that a maximum shear area is obtained by a shear force of the terminal fitting.

According to the connector having the structure in (1), the beak to be engaged with a terminal engagement hole has an upper surface formed by the inclined surface with a height increased gradually toward the base end. In the beak, the thickness of the top portion is increased. Consequently, it is possible to enhance a strength of a shear fracture. Moreover, a height of a terminal contact tip surface is not increased. Therefore, it is impossible to ease an interference with a partner side male terminal tab. In addition, a hanging margin of the beak with respect to the terminal engagement hole is prevented from being excessive. Consequently, it is possible to inhibit a releasing performance from being deteriorated. Moreover, an unnecessary increase in a material is not caused in the case in which the height of the terminal contact tip surface is increased. Therefore, it is possible to efficiently enhance a shear strength, thereby increasing a holding force against a decrease in a lance holding force which is caused by a reduction in a size.

(2) The connector according to (1), wherein the inclined surface is set to have an inclination angle along a track of a shear fracture in the beak.

According to the connector having the structure in (2), the inclined surface to be the upper surface of the beak is formed at the inclination angle along the track of the shear fracture in the beak. When the shear fracture occurs, therefore, a propagating direction of the fracture is almost coincident with the longest direction of the beak shape. In other words, it is possible to enhance a shear fracture strength by an increase in a minimum beak volume, thereby preventing an unnecessary increase in a material from being caused.

BEST MODE FOR CARRYING OUT THE INVENTION

Figure 1:
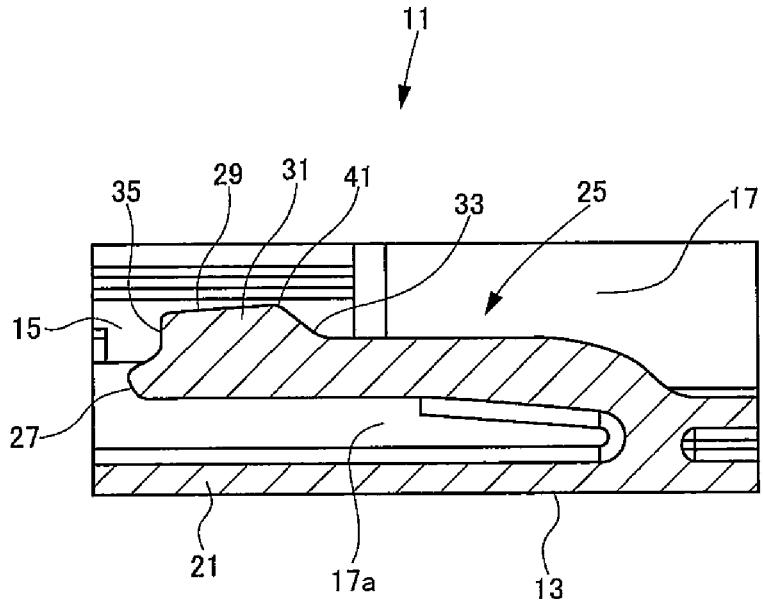
FIG. 1 is a sectional view showing a main part of a connector according to an embodiment of the invention.

An embodiment according to the invention will be described below with reference to the drawings.

In a connector 11 according to the embodiment, a plurality of terminal receiving ports 15 for receiving a male terminal of a partner side connector which is not shown is provided on an end face in a longitudinal direction of a connector housing 13 formed to be a rectangular parallelepiped. The terminal receiving ports 15 communicate with a plurality of terminal accommodation chambers 17 formed by a division in the connector housing 13, respectively. In this specification, for convenience of description, the terminal receiving port 15 of the connector 11 is referred to as a front part and an opposite side thereto is referred to as a rear part.

Figure 2:
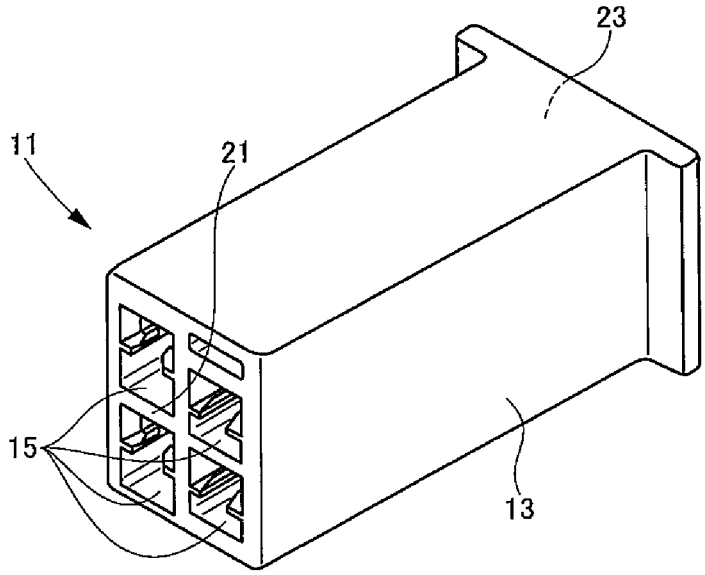
FIG. 2 is a perspective view showing an external appearance of the connector illustrated in FIG. 1.
Figure 3:
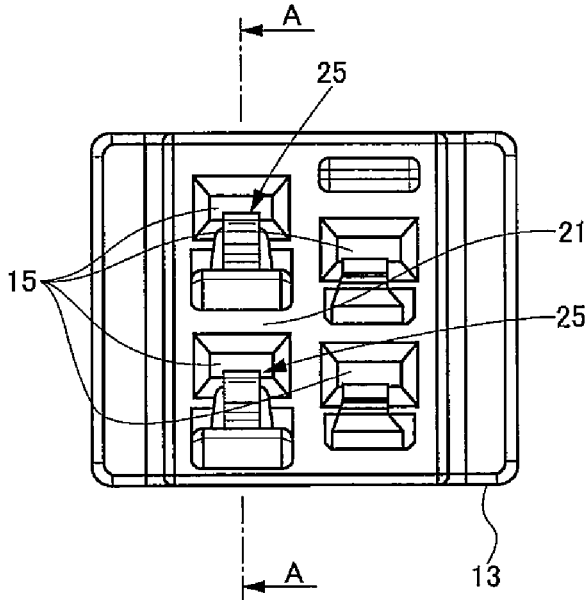
FIG. 3 is a front view of FIG. 2.
Figure 4:
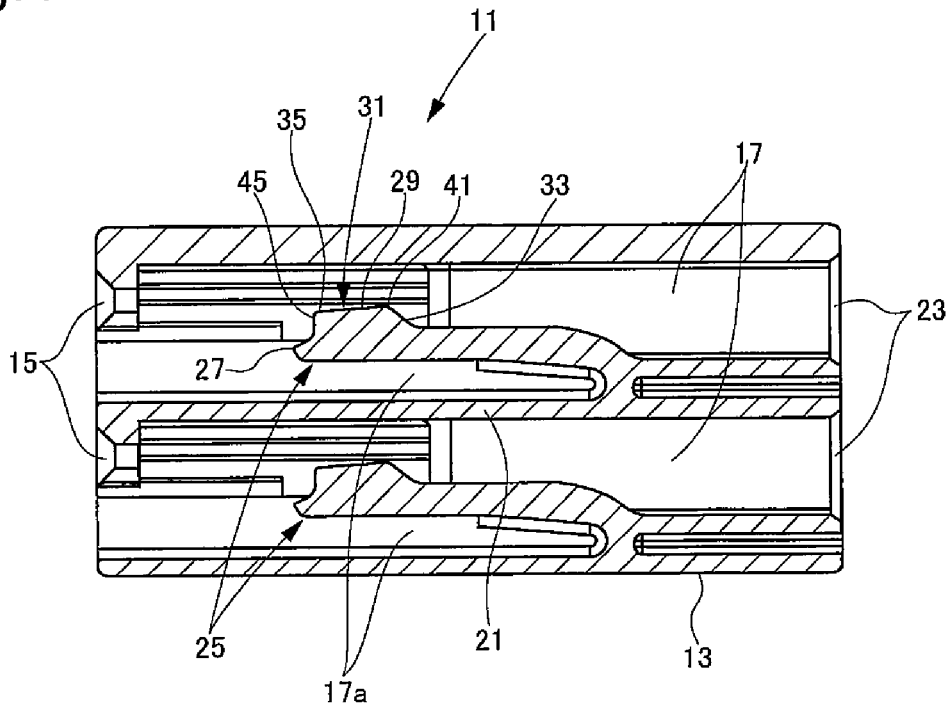
FIG. 4 is a view seen in an arrow of A-A in FIG. 3.
Figure 5:
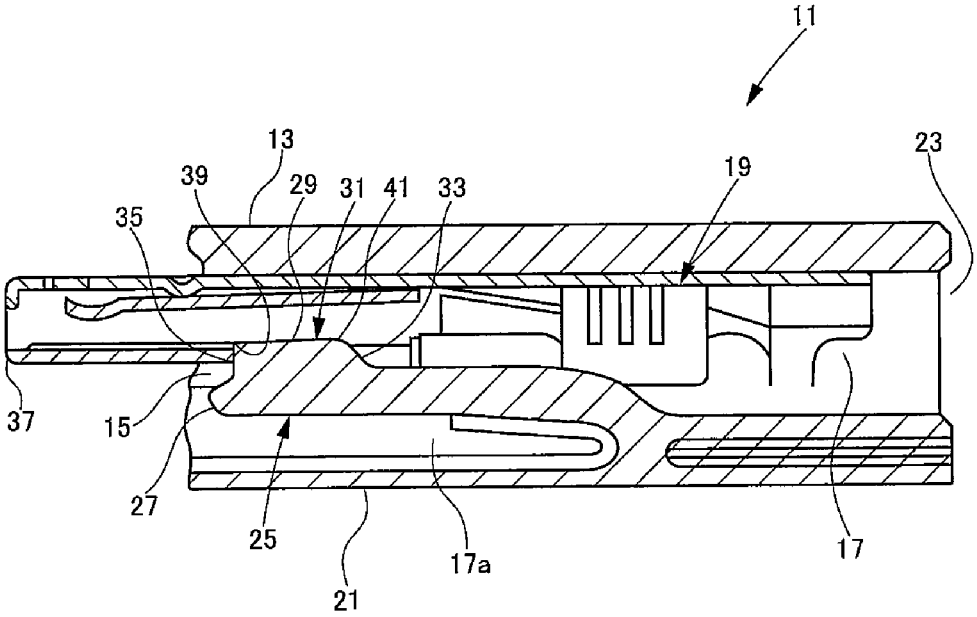
FIG. 5 is a sectional view showing a terminal accommodation chamber having a terminal fitting inserted therein.

FIG. 3 is a front view of FIG. 2, FIG. 4 is a view seen in an arrow of A-A in FIG. 3, and FIG. 5 is a sectional view showing the terminal accommodation chamber 17 having a terminal fitting 19 inserted therein.

The terminal accommodation chamber 17 and the terminal accommodation chamber 17 in a lower stage are partitioned from each other through a bottom wall 21. The female type terminal fitting 19 is inserted into the terminal accommodation chamber 17 from a terminal attachment port 23 formed in a rear portion of the connector housing 13. The female type terminal fitting 19 is only illustrative and may be of a male type. A flexible engagement piece 25 is protruded into a space to which the terminal fitting 19 is to be attached. The flexible engagement piece 25 is formed integrally with the connector housing 13 by a synthetic resin material. The flexible engagement piece 25 having a base end connected to the bottom wall 21 includes a tip serving as a free end 27. The flexible engagement piece 25 has the base end supported like a cantilever by the bottom wall 21 and is thus deformable elastically. A retreat space 17*a* is formed between the flexible engagement piece 25 and the bottom wall 21 below the flexible engagement piece 25.

In the flexible engagement piece 25, a terminal engagement portion (a beak) 31 is formed on an upper surface in the vicinity of the free end 27. The beak 31 has a rear part serving as an inclined surface 33 and a front part serving as an engagement portion 35. When the terminal fitting 19 is to be inserted, an electric contact portion tip 37 (see FIG. 5) of the terminal fitting 19 collides with the inclined surface 33, thereby generating a component of force for pushing the flexible engagement piece 25 downward to the retreat space 17*a*. When the flexible engagement piece 25 is elastically returned to an original position, the engagement portion 35 is engaged with an engagement hole 39 (see FIG. 5) of the terminal fitting 19, thereby controlling a rearward removal of the terminal fitting 19.

In the flexible engagement piece 25, the beak 31 formed on the free end 27 to engage the terminal fitting 19 takes a shape of an inclined surface 29 having a height of a top portion 41 increased gradually from the free end 27 toward the base end in such a manner that a maximum shear area is obtained by a shear force of the terminal fitting 19 (an open edge of the engagement hole 39).

In the embodiment, the inclined surface 29 is set to have an inclination angle along a track 43 (see FIG. 6) of a shear fracture in the beak 31. The inclined surface 29 to be the upper surface of the beak 31 is formed at the inclination angle along the track 43 of the shear fracture. When the shear fracture in the beak 31 occurs, therefore, a propagating direction of the fracture is almost coincident with the longest direction of the beak shape. In other words, it is possible to enhance a shear fracture strength by an increase in a minimum beak volume, thereby preventing an unnecessary increase in a material from being caused.

Next, description will be given to an action of the connector 11 having the structure.

Figure 6:
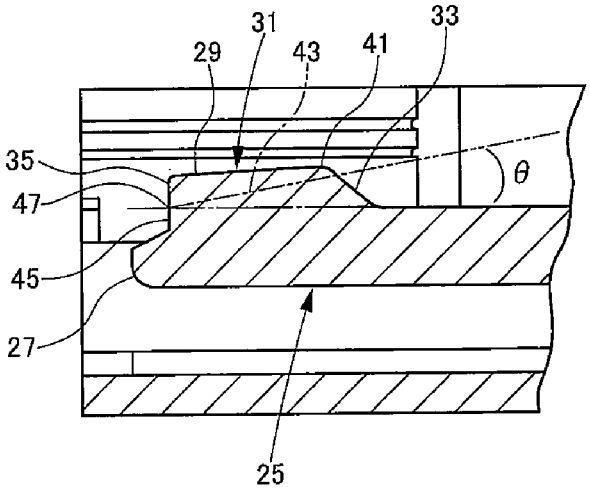
FIG. 6 is a sectional view showing the vicinity of a beak, illustrating a track of a shear fracture.
Figure 7A:
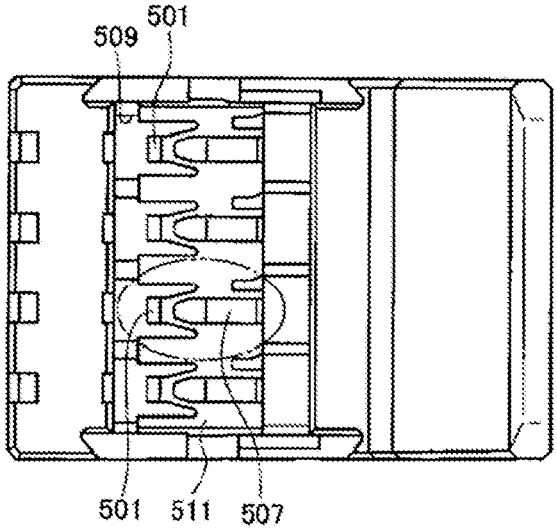
Fig.7(a) Prior Art
FIG. 7(*a*) is a plan view showing a conventional connector and FIG. 7(*b*) is an enlarged view showing a main part of a portion surrounded by a rounded envelope.
Figure 7B:
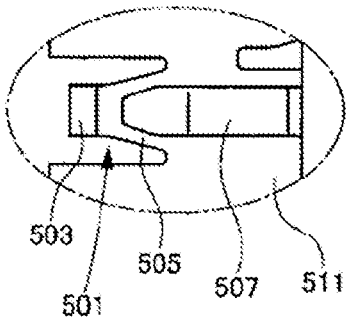
Fig.7(b) Prior Art

FIG. 6 is a sectional view showing the vicinity of the beak, illustrating the track 43 of the shear fracture.

When the terminal fitting 19 is inserted from the terminal attachment port 23 in the rear portion of the connector housing 13 in the attachment of the terminal fitting 19, a tip of the terminal fitting 19 abuts on the inclined surface 33 of the flexible engagement piece 25. When the terminal fitting 19 is further inserted, the flexible engagement piece 25 having the inclined surface 33 pressed is elastically deformed by flexing the free end 27 in such a direction as to move to the retreat space 17*a*.

When the terminal fitting 19 is inserted into a predetermined position, the engagement hole 39 (the terminal engagement hole) of the terminal fitting 19 is coincident with the engagement portion 35 so that the flexible engagement piece 25 is returned to the original position by an elastic returning force. Therefore, the terminal fitting 19 is brought into an engagement state in which the engagement portion 35 enters the engagement hole 39. The terminal fitting 19 having the engagement portion 35 engaged with the engagement hole 39 is controlled for a removal from the rear portion of the connector housing 13.

The beak 31 having the flexible engagement piece 25 includes a horizontal upper surface in the conventional lance. In the case in which the height of the beak 31 is varied, the height of the whole lance beak is increased/decreased. When the whole upper surface of the lance beak is increased to enhance a holding force, however, there is caused a possibility that a partner side male terminal tab and the upper surface of the lance beak might interfere with each other and an excellent terminal engagement situation cannot be brought. Moreover, the lance beak is not usually cut horizontally as a shear fracture mode of the lance but is broken down toward the upper surface of the beak 31 at an angle θ from a contact point 47 of a terminal contact tip surface 45. This implies that a simple increase in the height of the terminal contact tip surface 45 is not related to an increase in a shear strength, resulting in a loss of a material. With the structure, a height of a beak rear end is increased for only the angle θ which is required for a shear. By increasing a shear area through the shear force of the terminal fitting 19, consequently, it is possible to increase the shear strength of the beak 31 more efficiently.

More specifically, in the increase in the shear strength to increase the holding force, it is possible to enhance the holding force through a minimum variation in the beak height. It is possible to increase the shear strength without increasing the height of the terminal contact tip surface 45. It is possible to avoid a problem of the interference of the partner side male terminal tab and to minimize an increase in the material, which is also excellent in respect of an environment. For a reduction in a size and a weight, moreover, it is possible to carry out a design more efficiently. Also in the case of a terminal release, furthermore, it is not necessary to increase the height of the terminal contact tip surface 45. Therefore, it is possible to carry out the release conventionally or more efficiently.

Referring to the connector 11, thus, the beak 31 for engaging the engagement hole 39 of the terminal fitting 19 has the upper surface formed by the inclined surface 29 with a height increased gradually toward the base end. In the beak 31, the thickness of only the top portion 41 is increased. By substantially increasing the shear area through the shear force of the terminal fitting 19, consequently, it is possible to enhance the strength of the shear fracture. Furthermore, the height of the terminal contact tip surface 45 is not increased. Therefore, it is impossible to ease an interference with the partner side male terminal tab. In addition, a hanging margin of the beak 31 with respect to the engagement hole 39 is prevented from being excessive. Consequently, it is possible to inhibit a releasing performance from being deteriorated. Moreover, an unnecessary increase in a material is not caused in the case in which the height of the terminal contact tip surface 45 is increased.

According to the connector 11 in accordance with the embodiment, therefore, it is possible to efficiently enhance a shear strength, thereby increasing a holding force against a decrease in a lance holding force which is caused by a reduction in a size.

Although the connector according to the invention has been described above in detail with reference to the specific embodiment, the invention is not restricted to the embodiment but it is of course that the invention can be variously changed and executed without departing from the gist of the invention.

The application is based on Japanese Patent Application (Japanese Patent Application No. 2010-192424) filed on Aug. 30, 2010 and contents thereof are incorporated herein by reference.

INDUSTRIAL APPLICABILITY

According to the invention, it is possible to provide a connector capable of efficiently enhancing a shear strength to increase a holding force against a decrease in a lance holding force which is caused by a reduction in a size.

EXPLANATION OF DESIGNATION

11 connector
17 terminal accommodation chamber
19 terminal fitting
25 flexible engagement piece
27 free end
29 inclined surface
31 beak
41 top portion
43 track

The invention claimed is:

1. A connector, comprising:

a flexible engagement piece which has a base end supported like a cantilever in a terminal accommodation chamber for accommodating a terminal fitting so as to be deformable elastically, and has a free end with which the terminal fitting to be inserted into the terminal accommodation chamber is engaged, wherein the flexible engagement piece includes a beak formed on the free end to engage the terminal fitting therewith, the beak having an inclined uppermost surface with which a thickness of the beak gradually increases from the free end of the flexible engagement piece toward the base end thereof in such a manner that a maximum shear area is obtained by a shear force of the terminal fitting.

2. The connector according to claim 1, wherein the inclined uppermost surface is set to have an inclination angle along a track of a shear fracture in the beak.

* * * * *